US005154419A

United States Patent [19]

Madhavan

[11] Patent Number: 5,154,419

[45] Date of Patent: Oct. 13, 1992

[54] GAME BOARD STORAGE AND RETRIEVAL SYSTEM

[76] Inventor: Jayadev Madhavan, 6109 Pratt Dr., New Orleans, La. 70122

[21] Appl. No.: 727,004

[22] Filed: Jul. 8, 1991

[51] Int. Cl.[5] ..... A63F 7/36

[52] U.S. Cl. ..... 273/126 R; 273/309; 273/113; 273/12; 273/287; 273/3 R

[58] Field of Search ..... 273/309, 287, 2, 3, 273/12, 108, 113, 118 R, 118 A, 123 R, 123 A, 126 R, 126 A

[56] References Cited

U.S. PATENT DOCUMENTS

| | | | |
|---|---|---|---|
| 1,535,484 | 4/1925 | Kohl | 273/309 |
| 1,568,154 | 1/1926 | Hannon et al. | 273/309 |
| 2,199,745 | 5/1940 | Harris | 273/309 |
| 3,947,035 | 3/1976 | Bouchard | 273/126 R |
| 4,065,125 | 12/1977 | Chan | 273/287 X |
| 4,146,228 | 3/1979 | Laciste | 273/126 R |
| 4,283,054 | 8/1981 | Patella et al. | 273/126 R |

*Primary Examiner*—Theatrice Brown
*Assistant Examiner*—Raleigh W. Chiu
*Attorney, Agent, or Firm*—C. Emmett Pugh

[57] ABSTRACT

A new and improved game board for use in the playing of a traditional board game of India known as CAROM. The improvements of the present invention relate primarily to a spring biased, rotatable pocket system (FIGS. 1-3) for facilitating removal of the game pieces, as well as a concealed and compact, locking and spring biased storage compartment (FIGS. 4-6). The pocket system of the preferred embodiment of the invention comprises four independent, corner pockets, each having a locking bias to facilitate the positioning of each pocket in a position for catching game pieces falling into the pocket area, or in a position exterior to the board, for removal of the pieces for continued play or storage. The storage compartment provides an improved system for maintaining the many game pieces used in playing the game, while not in use. The compartment of the preferred embodiment comprises a slotted, biased drawer arrangement with a locking mechanism, the drawer being configured to be positioned flush with the underside of the game board while in the closed position, while in a released, opened mode positioned to be easily removed from the underside of the game board.

3 Claims, 4 Drawing Sheets

GAME BOARD STORAGE AND RETRIEVAL SYSTEM

Background of the Invention

1. Field of Invention

The present invention relates to board games and more particularly to a new and improved game board for use in the playing of a traditional board game of India known as CAROM.

The present game board incorporates features and construction unlike any previously known in the playing of the game, which heretofore was traditionally played on a rather simple, flat board having a raised periphery.

The improvements of the present invention relate primarily to a spring biased, rotatable pocket system for facilitating the removal of the game pieces, as well as a concealed and compact, locking and spring biased storage compartment.

The pocket system of the preferred embodiment of the invention comprises four independent pockets, each having a locking bias to facilitate the positioning of each pocket in positions for catching game pieces falling into the pocket area, or in a position exterior to the board, for removal of the pieces for continued play or storage.

The storage compartment provides an improved system for maintaining the many game pieces used in playing the game while not in use. The compartment of the preferred embodiment comprises a slotted, biased drawer arrangement with a locking mechanism, with the drawer being configured to be positioned below the underside of the game board while in the closed position, while in a released, easily accessible mode positioned to be easily removed from the underside of the board.

2. Prior Art & General Background

While applicant knows of no prior patents relating to the traditional CAROM game, there does exist prior art relating to diverse games having billiard-type pockets incorporated therein, as well as prior art teaching games having plain, drawer-type storage incorporated therewith. However, this prior art is fully distinguishable from the present invention in both method as well as apparatus.

A list of prior patents which may be of interest is presented below:

| Patent No. | Patentee(s) | Issue Date |
|---|---|---|
| D 231,542 | D. Munson | Apr 30, 1974 |
| 175,495 | H. Pottin | Mar 28, 1876 |
| 250,458 | W. T. Shay | Dec 06, 1881 |
| 252,805 | F. Saunders | Jan 24, 1882 |
| 322,436 | N. H. Ganser | Jul 21, 1885 |
| 472,423 | F. E. Augustin | Apr 05, 1892 |
| 526,908 | G. Parker & J. Friend | Oct 02, 1894 |
| 597,755 | S. Wilson | Jan 25, 1898 |
| 688,027 | J. Moyer | Dec 03, 1901 |
| 715,794 | H. Haskell | Dec 16, 1902 |
| 753,561 | C. Edmunds | Mar 01, 1904 |
| 810,224 | F. Sackett | Jan 16, 1906 |
| 847,655 | C. Davidson | Mar 19, 1907 |
| 1,121,184 | F. Hobbs | Dec 15, 1914 |
| 1,335,924 | J. Trew | Apr 06, 1920 |
| 1,422,397 | J. Watson | Jul 11, 1922 |
| 1,546,831 | L. Fritz | Jul 21, 1925 |
| 2,361,471 | C. Fontaine, Jr | Oct 31, 1944 |
| 2,640,697 | F. Elersich | Jun 02, 1953 |
| 3,023,007 | L. Lowrey | Feb 27, 1962 |
| 3,042,407 | D. Gorgol | Jul 03, 1962 |

-continued

| Patent No. | Patentee(s) | Issue Date |
|---|---|---|
| 3,073,601 | S. Baillo | Jan 15, 1963 |
| 3,236,522 | R. Brown | Feb 22, 1966 |
| 4,003,577 | J. Bolach | Jan 18, 1977 |
| 4,030,765 | J. Brown | Jun 21, 1977 |
| 4,065,125 | P. Chan | Dec 27, 1977 |

As may be seen from a review of the above, the prior art contemplates various apparatus having diverse pocket configurations incorporated therein. These apparatus include traditional billiard or pool tables, as well as some game boards having pocket receiving apparatus for receiving a game piece. However, the mechanical structure of these apparatus does not provide a suitable system for use with the game of the present invention.

Further, while there may exist many patents teaching traditional drawer configured storage systems as set forth in the above, none contemplate a concealed and compact, locking and biased storage system as taught in the present invention.

The prior art patents which claim specifically pocket structure are for the most part limited to pool and billiard tables, and would not function satisfactorily with the present game, and are truly distinguishable in configuration from that contemplated in the preferred and exemplary embodiments of the claimed invention, which contemplates a notched, biased pocket which swivels along an axis perpendicular to the game board from a position under the pocket to an area exterior the board, allowing easy access to the "caught" game pieces when desired.

Other unpatented game boards teach a piece of netting affixed below the corner pocket holes to collect the "pocketed" playing pieces. These pieces are recovered by picking them up through the pocket hole, an inconvenient procedure in view of the size of the hole and the difficulty in gripping the game piece on the netting in the pocket. To further increase the difficulty, the game board must not be disturbed in removing the "pocketed" pieces, due to the presence of other game pieces during the game.

3. General, Summary Discussion of the Invention

The present invention overcomes these prior art problems by providing a system wherein the pockets are rotatable about an axis in order to provide a game piece removal system that is simple yet much less difficult than that contemplated by the prior art.

With the present invention, a pivoted frame with a shallow pouch is positioned under the pocket holes to collect the pocketed playing pieces called "jems". To retrieve the jems, the pocket is swung clear of the underside of the board, on a spring biased axle, from a biased pocketing position, to a biased removal position.

The pocket system of the preferred embodiment of the invention comprises four independent pockets, each having a locking bias to facilitate the positioning of each pocket in positions for catching game pieces falling into the pocket area, or in a position exterior to the board, for removal of the pieces for continued play or storage.

The storage compartment provides an improved system for maintaining the many game pieces used in playing the game while not in use. The compartment of the preferred embodiment comprises a slotted, biased drawer arrangement with a locking mechanism, the drawer being configured to be positioned below the underside of the game board while in the closed position, while in a released, easily accessible mode positioned to be easily removed from the underside of the board.

The present storage system provides a storage container which may be locked in a closed position in such a fashion that movement of the board or even tilting to any side will not open the drawer, spilling the game pieces.

This is in contrast to the storage system of the above disclosed prior art embodiments, which taught for the most part standard configuration drawers which provided little if any protection from opening when the board was moved or in transit. Further, the present storage system is smartly hidden from view, which adds to the appearance of the game board during display. It is here noted that the game board of the present game may be a work of art in itself, with inlays of intricate and beautiful design of a variety of woods.

It is therefore an object of the present invention to provide a superior game board over that contemplated over the prior art, wherein the improvement would comprise game pockets of new and unique configuration which would allow easy access to game pieces once pocketed.

It is another object of the present invention to provide an improved game board wherein there is included a hidden storage system having locked "closed" and "open" positions.

It is a further object of the present invention to provide a CAROM type game board having improved playing and storage characteristics.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENT(S)

Pivoted Pocketing System

Figure 1:
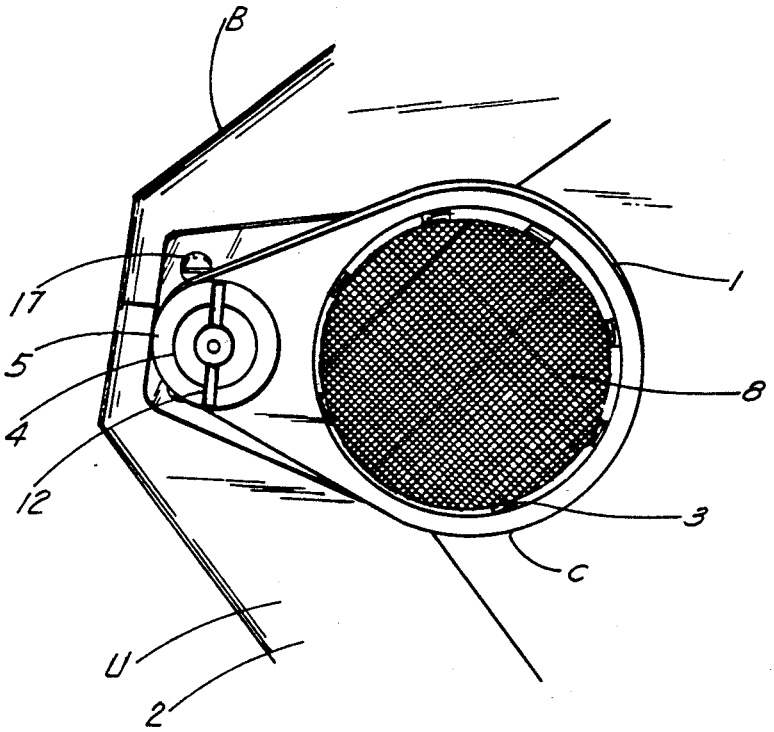
FIG. 1 is a bottom, partial, plan view of the preferred embodiment of the game board of the present invention, illustrating the corner pivoted pocketing system in its closed position.
Figure 2:
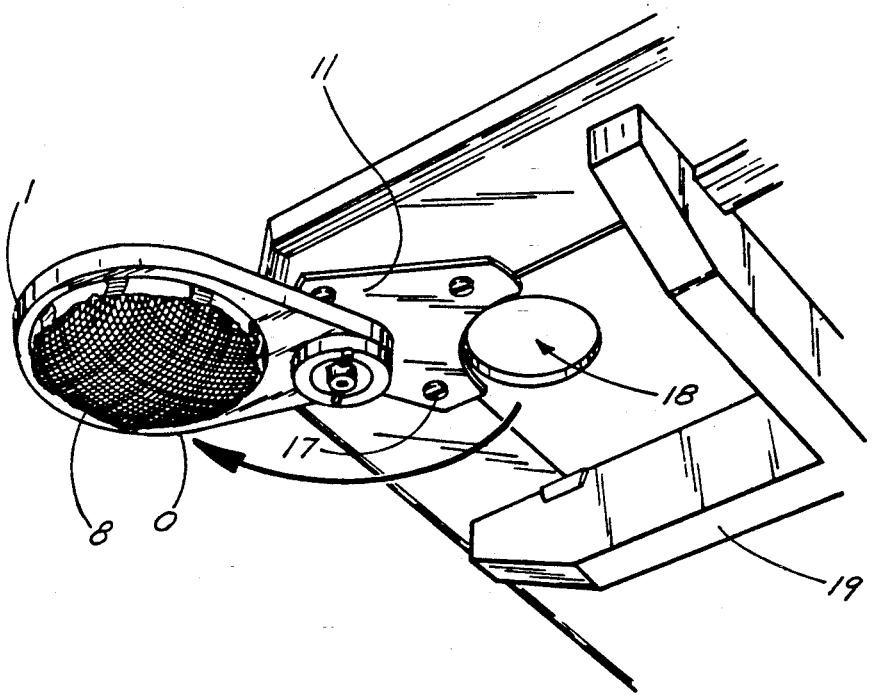
FIG. 2 is a bottom, partial, perspective view of the game board of FIG. 1, illustrating the pivoted pocketing system in its opened position.
Figure 3:
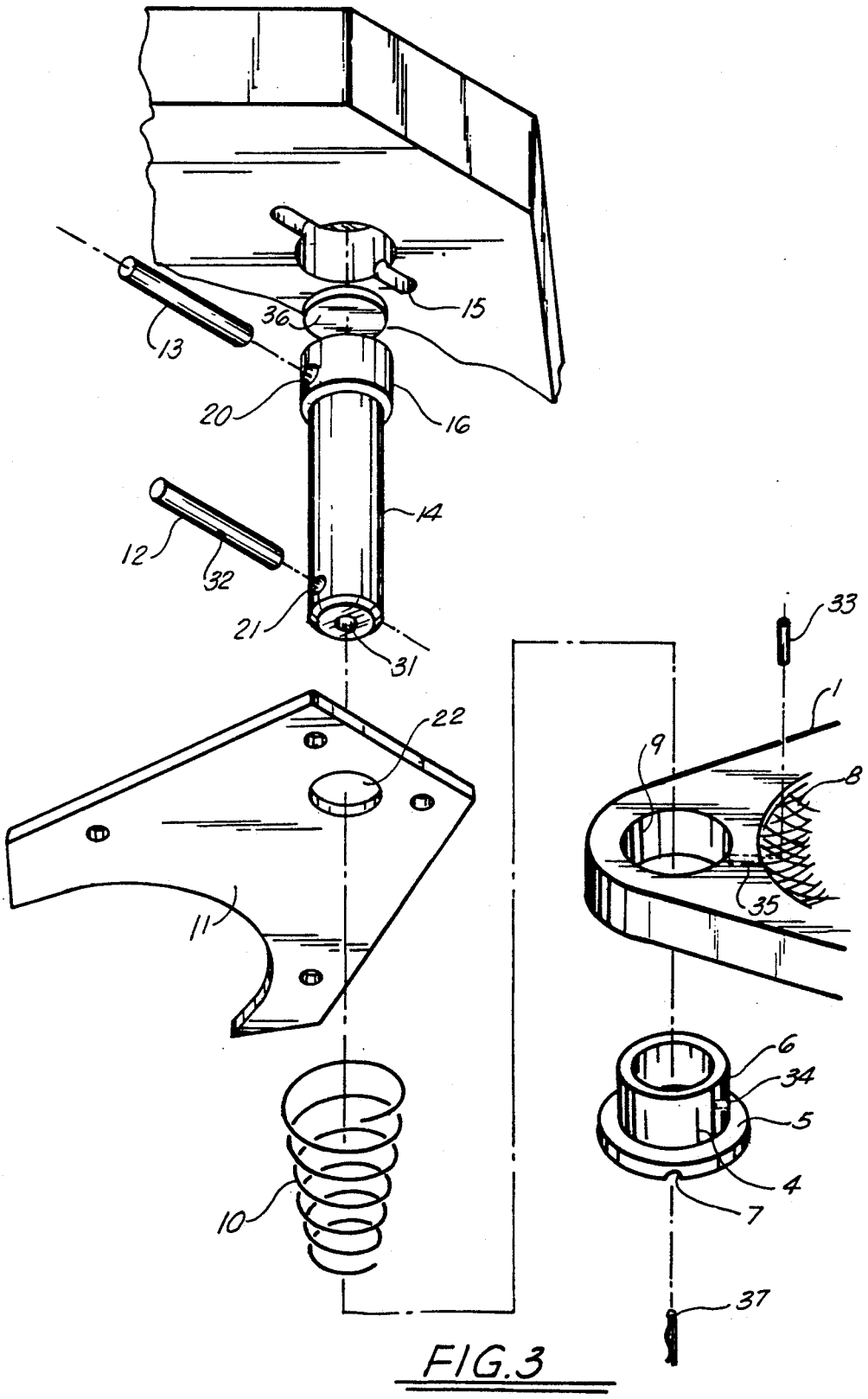
FIG. 3 is a bottom, exploded, perspective view of the game board of FIG. 1, illustrating the various components of the spring biased pocket of the pivoted pocketing system.

As can be seen in FIGS. 1–3, the pivoted pocketing system of the preferred, exemplary embodiment of the present invention, includes a game board B, comprised of a relatively flat, rectilinear or square surface of wood or like material, having edge reenforcement members 2 incorporated about the periphery of same for providing a raised periphery for the game surface. As can be seen in FIG. 2, grid members 19 are provided on the underside of the game board for reinforcement and for space for accommodating the storage and retrieval system.

Situated in each corner area of the game board B is a circular pocket 18, configured for accepting the game piece or "jem" when said piece passes over the pocket area. In the present invention, a pivotable receptacle 1 is provided at the underside U of the game board to catch the game piece which passes through the pocket area.

The receptacle comprises a frame of wood, plastic or the like configured to support a net 8 for catching the falling game pieces. The net is affixed to the receptacle via spaced straps 3. Situated distal to the net area is a mounting aperture 9 (note FIG. 3). The receptacle 1 is pivotally affixed to the game board B via a biased axle system, as further illustrated in FIG. 3.

A retainer/bearing 4 is provided having a lip 5 with a linear notch 7 and barrel 6 configured to engage and interfere with the circular mounting area 9 of the receptacle 1.

Placed in mounting area 15 of the board is axle !4 having a lip 16 and pin holes 20, 21, and 31. Mounting area 15 comprises a void configured for accepting the lip portion 16 of axle 14 with retainer pin 13 inserted in pinhole 20, with a shim 36 being included for providing a tight fit.

Once placed in the mounting area, the retainer pin 13 locks the axle 14 in place after the base plate is threadingly connected to the board via wood screws 17 or the like. Base plate includes an aperture 22 for accepting axle 14; while the portion of axle 14 emanating from base plate 11 has a spring 10 placed about it for providing outward bias to the retainer/bearing member 4, which is placed about axle 14 after spring 10.

Retainer/bearing 4 has enveloped about its barrel piece 6 the receptacle 1, which engages retainer/bearing 4 via the mounting area 9, and is locked to receptacle 1 via pin 33 situated in receptacle aperture 35 and retainer/bearing aperture 34. After passing throughout the lip area 5 of the retainer/bearing 4, axle 14 is configured to accept the retainer pin 12 via pin hole 21 in order to hold together the above discussed components in a working system. Once installed, the retainer pin is biased against the retainer/bearing member 4 via the spring 10; with the bias allowing the locking of the receptacle 1 in a "closed" C or "open" O position (illustrated in FIGS. 1 and 2, respectively) via the retainer pin 12 communicating with the notch 7 on the retainer/-bearing member 4.

To further lock the system securely together, locking pin 37 is placed into axle aperture 31, communicating with pin 12 via aperture 32, locking the pin 12 in place.

In use, the receptacle is held under the pocket 18 in its closed position via the above bias. When a game piece or "Jem" falls through the pocket, it is caught and retained by net 8. Removal of the game piece from the receptacle 1 is simply a matter of rotating it about axle 14, by merely grasping the receptacle piece and applying sufficient force to extricate the retainer pin 12 from the notch 7, and bringing the receptacle about the axle until the net area is removed from under the game board, providing easy access to the game pieces.

The materials as used in the exemplary embodiment for the pocket system are as follows:

| | |
|---|---|
| Retainer/Bearing member 4 | NYLON TM |
| Base Plate 11 | ⅛" wood |
| Receptacle 1 | ⅛" plywood |
| Pins 12, 13, 33, 37 | Brass |
| Axle 14 | Brass or NYLON TM |

Hidden Drawer System

Figure 4:
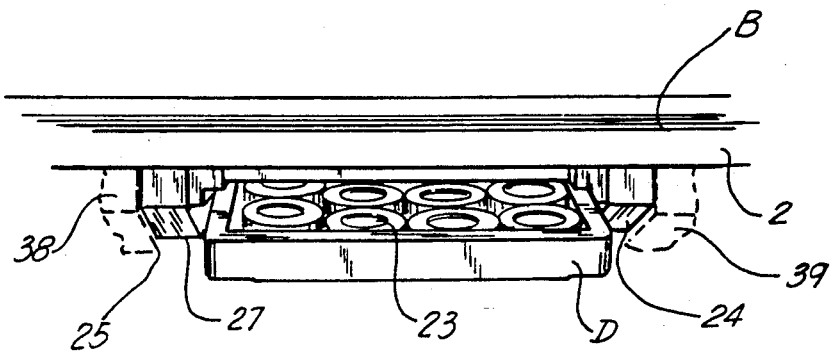
FIG. 4 is an end partial view of the hidden drawer part of the game board of FIG. 1, illustrating the assembled drawer and its relationship to an exemplary locking storage system, in the opened position.
Figure 5:
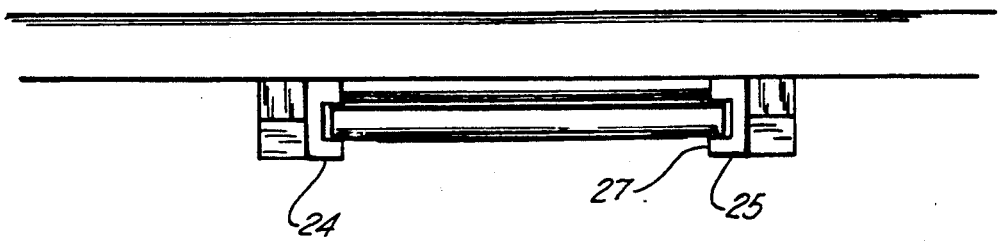
FIG. 5 is an end, partial view, similar to that of FIG. 4, illustrating the assembled drawer and its relationship to an exemplary locking storage system, but in the closed position.

FIGS. 4–6 illustrate the storage/retrieval system for the game pieces 23 of the present invention. The drawer D is slidingly engaged to the game board B via slotted support members, having slotted sides 24, 25. Slotted support member 27 is threadingly affixed to the side walls of grid members 38, 39 of the game board B and side grid member 2 such that the drawer is flush well within the periphery of the game board edge when in the closed position, as illustrated in FIG. 5.

Figure 6A:
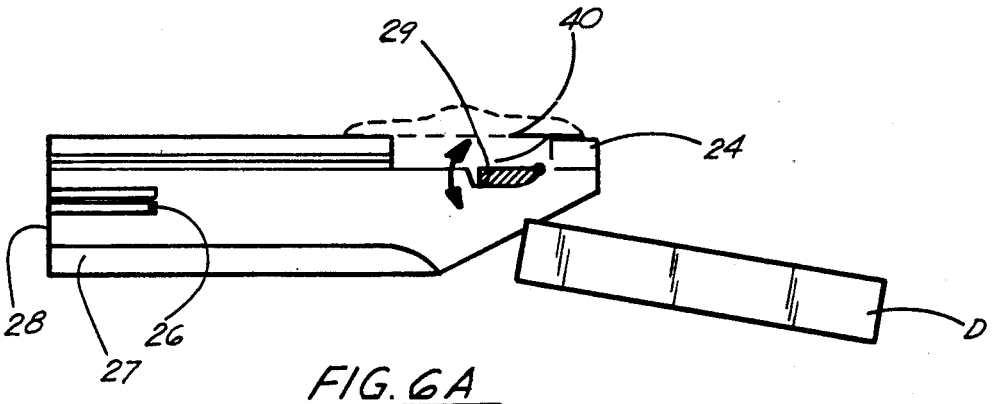
FIG. 6A–6D are side, cutaway views of the drawer part of the game board of FIGS. 1 and 4 and 5, illustrating the positioning and configuration of the slots of the exemplary locking storage system, as well as the placement and configuration of the biased ejector springs in relation to the drawer member in its varying stages of closing.
Figure 6B:
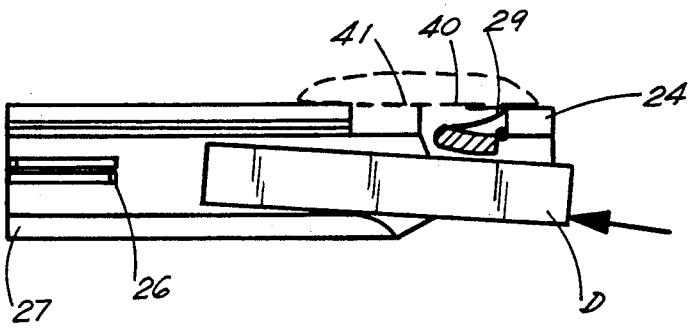
Figure 6C:
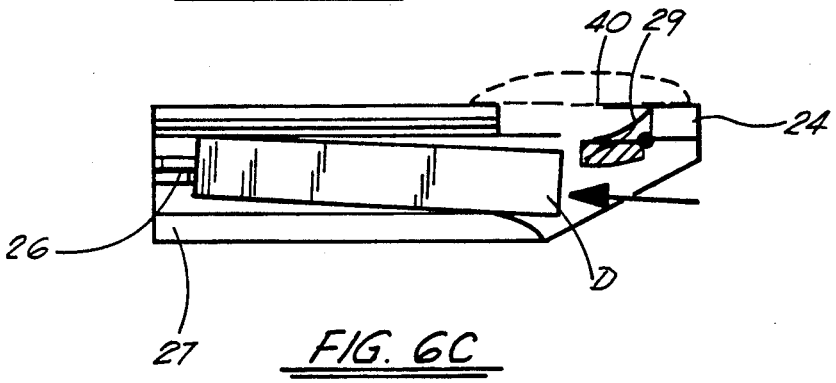
Figure 6D:
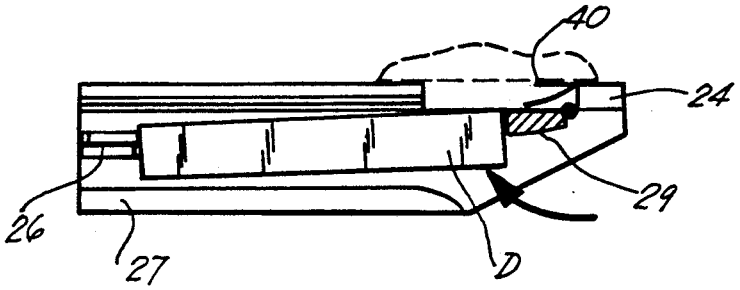

FIGS. 6A–6D illustrate the slotted arrangement which allows the drawer D to lock in a hidden storage position. As shown in the cutaway figures, sides 24, 25 of slotted support member 27 are configured to accept and slidingly engage drawer D such that it is directed into a flush, locked position relative the game board, as illustrated in FIG. 6D. Spring bias for holding the drawer in a locked position is provided by spring tongs 26 affixed to the rear inner slotted portion 28 of slotted support member 27.

In operation, the user merely places the game pieces in the drawer, sliding the drawer into the slotted area as with any standard drawer configuration, passing the drawer against lip 29, which is pushed up via its radial underside, and against torsion spring 40, providing downward bias. The user then forces the drawer against the spring tongs 26 (FIG. 6C), until the drawer is sufficiently far back as to allow the lip to come down via torsion spring 40.

Opening the drawer is merely a matter of reaching into the slotted area, and simultaneously pushing upwardly against lip 29, thereby unlocking it from its storage position, and allowing the spring tongs 26 to eject the drawer into the open position.

Exemplary Dimensions

| Item | EXEMPLARY DIMENSIONS |
|---|---|
| Game Board | 27" × 27" × 2¼" (Length × Width × Depth) |
| Drawer | 5¾" × ¾" × 4¼" (Length × Width × Depth) |
| Slot | 5 13/16" × ¾" × 4½" (Length × Width × Depth) |
| Pocket Pouch (diameter) | 3" |
| Game Piece (diameter) | 1¼" or 1½" |
| Pocket (Diameter) | 1¾" |

The embodiment(s) described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A game board storage and retrieval system for a game board having an underside, configured for the maintenance of game pieces, comprising:

at least one pocket, said pocket further comprising a receptacle having a structure configured for adjustable positioning under said pocket, said receptacle further comprising an axle affixed to the game board, said receptacle further comprising pivot means for pivoting said receptacle about said axle;

drawer storage means, said drawer storage means comprising at least one drawer configured to contain a plurality of the game pieces, said drawer storage means further comprising a storage member affixed to the underside of the game board, said storage member having a rear portion incorporating spring bias means and a front portion having a lip having downward spring bias means, said storage member being configured to slidingly accept said drawer, such that said drawer, when pushed toward the rear portion of said storage member, said rear portion spring bias forces said drawer against said lip, locking it into a position juxtaposed to the underside of the game board.

2. The pocket of claim 1, wherein said pivot means further comprises an axle held in perpendicular communication with the underside of the game board, a spring configured to envelope said axle, and said receptacle being affixed to said axle via a retainer and bearing arrangement.

3. A method of managing and storing game pieces for a game, comprising the following steps:

(a) providing a game board having an underside and a topside, said game board further including at least one pocket, said pocket further comprising a receptacle having a structure configured for adjustable positioning under said pocket, said receptacle further comprising an axle affixed to the game board, said receptacle further comprising pivot means for pivoting said receptacle about said axle;

drawer storage means, said drawer storage means comprising at least one drawer configured to contain a plurality of the game pieces, said drawer storage means further comprising a storage member affixed to the underside of the game board, said storage member having a rear portion incorporating spring bias means and a front portion having a lip having downward spring bias means, said storage member configured to slidingly accept said drawer such that said drawer, when pushed toward the rear portion of said storage member, said rear portion spring bias forcing said drawer toward and against said lip, locking it into a position juxtaposed to the underside of the game board;

(b) sliding at least one of the game pieces across the topside of the game board, and into said pocket such that is directed onto said receptacle;

(c) pivoting said receptacle from the underside area of the game board such that the game piece is easily accessible for removal;

(d) placing the game piece in said drawer;

(e) sliding said drawer in said storage member toward the rear area;

(f) pressing said drawer against said spring bias; and (g) allowing said drawer to communicate with said lip of said storage member, locking said drawer to place in a hidden position flush with the underside of the game board.

* * * * *